US008029711B2

(12) United States Patent
Grefhorst et al.

(10) Patent No.: US 8,029,711 B2
(45) Date of Patent: Oct. 4, 2011

(54) METHOD FOR PRODUCING A CORE SAND AND/OR MOLD SAND FOR FOUNDRY PURPOSES

(75) Inventors: Cornelis Grefhorst, ZZ Winterswijk (NL); Spyridon Tzintzos, Athens (GR)

(73) Assignee: S & B Industrial Minerals GmbH, Oberhausen (DE)

( * ) Notice: Subject to any disclaimer, the term of this patent is extended or adjusted under 35 U.S.C. 154(b) by 0 days.

(21) Appl. No.: 12/157,428

(22) Filed: Jun. 10, 2008

(65) Prior Publication Data

US 2009/0025606 A1 Jan. 29, 2009

(30) Foreign Application Priority Data

Jun. 12, 2007 (DE) ..... 10 2007 027 621

(51) Int. Cl.
*B22C 1/02* (2006.01)

(52) U.S. Cl. ..... 264/122; 106/38.28; 106/38.27; 366/141

(58) Field of Classification Search ..... 106/38.28, 106/38.27; 366/141; 264/122
See application file for complete search history.

(56) References Cited

U.S. PATENT DOCUMENTS

| | | | | |
|---|---|---|---|---|
| 2,828,214 | A | 3/1958 | Myers et al. | |
| 2,992,090 | A | 7/1961 | Littler | |
| 3,986,883 | A | 10/1976 | Toth et al. | |
| 4,039,169 | A * | 8/1977 | Bartholomew | 366/20 |
| 7,188,660 | B2 * | 3/2007 | Grefhorst et al. | 164/529 |

FOREIGN PATENT DOCUMENTS

| | | |
|---|---|---|
| DE | 24 53 552 | 5/1975 |
| DE | 30 17 119 | 11/1981 |
| DE | 30 39 032 | 5/1982 |
| DE | 10 2005 006 4 | 8/2006 |
| JP | 58-068446 | 4/1983 |

OTHER PUBLICATIONS

Schundler, Schundler Product Guide—Perlite for Textured Coatings, updated Jan. 4, 2007, http://web.archive.org/web/20070104102013/http://www.schundler.com/coatings.htm.*

Perlite Institute, Inc., "Origin and Characteristics of Perlite", p. 1 accessed at http://www.perlite.org/product_guides/1%20Basic%20Facts%20about%20Perlite.pdf on Mar. 10, 2010.*

The Vermiculite Association, "Vermiculite Properties", accessed on Oct. 25, 2010 at http://www.vermiculite.org/properties4.html.*

German Office Action dated Feb. 18, 2008 with English translation of relevant parts.

Römpp-Lexikon Chemie [Römpp-Lexicon of Chemistry], M-Pk, 1998, pp. 3194-3195, "Perlit" [Perlite]. (German OA).

(Continued)

*Primary Examiner* — Yogendra Gupta
*Assistant Examiner* — Alison Hindenlang
(74) *Attorney, Agent, or Firm* — Collard & Roe, P.C.

(57) ABSTRACT

A method for producing a core sand and/or mold sand for foundry purposes mixes a granular mineral mold base material with an additive and an inorganic binder. An inorganic swelling additive having a swelling index of at least 9, in other words a higher swelling index that that achieved for coal, is used as an additive. Alternatively, it is also possible to work with an inorganic additive, for example with macro-crystalline graphite, whereby the finished mixture of the mold base material, the additive, and the binder is compacted to a density increase of at least 20 g/dm$^3$.

14 Claims, 1 Drawing Sheet

OTHER PUBLICATIONS

Römpp-Lexikon Chemie, T-Z, 1999, pp. 4834-4835, "Vermiculit" [Vermiculite]. (German OA).

Grefhorst et al., "Bentonitgebundene Formstoffe ohne organische Zusätze für Eisenguss" [ Bentonite-bonded mold materials without organic additives for iron casting], Giesserei [Foundry], 2004, vol. 91, pp. 24-30. (German OA).

Grefhorst, C.,"Modern Bentonite Bonded Molds," Archives of Foundry, 2006, vol. 6 , Issue 20, pp. 51-57. (German OA).

* cited by examiner

METHOD FOR PRODUCING A CORE SAND AND/OR MOLD SAND FOR FOUNDRY PURPOSES

CROSS REFERENCE TO RELATED APPLICATIONS

Applicants claim priority under 35 U.S.C. §119 of German Application No. 10 2007 027 621.6 filed Jun. 12, 2007.

BACKGROUND OF THE INVENTION

1. Field of the Invention

The present invention relates to a method for producing a core sand and/or mold sand for foundry purposes, according to which a granular mineral mold base material is mixed with an inorganic additive and an inorganic binder.

Core sands for foundry purposes are generally used to define cores in cast pieces. In contrast, mold sand generally means a sand or sand-like mold base material that determines the outer shape of the desired cast piece. The terms core sand and mold sand are covered, for the most part, by the general term foundry sand or foundry mold base material, which means that the present case concerns itself not necessarily with sands but rather with granular foundry mold materials in general.

2. The Prior Art

In the production of core sands and/or mold sands for foundry purposes, usually, in addition to a binder such as bentonite, for example, a glance carbon forming agent or, in general, coal dust/hydrocarbon resin is added, as is described, for example, in DE 30 17 119 A1. Coal dust is used in the implementation of foundry sands essentially because an improved casting surface is achieved, and sand adhesions are avoided, to a great extent. Furthermore, the casting mold can be advantageously separated from the sand, and casting defects are reduced. Finally, metering can be performed in simple manner, and the costs are relatively slight.

These advantages, however, are achieved at the cost of disadvantages. For example, the strength of the casting mold suffers as the result of the dust addition. Also, harmful emissions resulting from the organic components in the foundry mold sand or foundry mold base material, for example carbon monoxide or sulfur dioxide, as well as benzene emissions, are observed. Furthermore, it cannot be prevented that the mold base material or mold sand, which is generally circulated and processed again, becomes contaminated, specifically by organic condensation products, benzene, and so forth. Furthermore, an increasing moisture content is observed, which can result in casting defects.

A method having the configuration described initially is presented, in terms of approach, in U.S. Pat. No. 2,828,214. Here, Example II discloses a composition for casting core molds and molds, which consists of sand, binders, and additives that are mixed. Additives on an organic basis, for example containing cellulose, are used. As a result, emissions must still be feared, and, in the final analysis, casting defects, as described, cannot be precluded. The present invention seeks to provide a remedy on the whole to these drawbacks.

SUMMARY OF THE INVENTION

It is an object of the present invention to provide a method of this type, in such a manner that in particular, harmful emissions are avoided and the casting quality is improved.

These and other objects are achieved, in one aspect of the invention, by a method of the stated type for producing a core sand and/or mold sand for foundry purposes, in which an inorganic swelling additive having a swelling index of at least 9 is used as an additive. In other words, an inorganic swelling additive is used that has a higher swelling index than coal, in any case.

Within the framework of one aspect of the invention, an inorganic additive is therefore explicitly used. Specifically a special additive, namely a swelling additive, may be used. Such swelling additives are characterized, within the framework of the invention, in that they have a swelling index (free swelling index) of at least 5, as is defined in greater detail in DIN 51741. Preferably, the swelling index even assumes values of more than 10, particularly more than 20. In general, the swelling index actually lies at approximately 100.

The swelling index expresses that the additive in question, i.e. the inorganic swelling additive such as perlite, vermiculite, or also (swelling) graphite, for example, multiplies its volume at a specific (high) temperature (swelling temperature), for example by ten times. A conclusion concerning the swelling index can then be drawn from the volume increase, whereby the multiplication of the volume approximately corresponds to the swelling index as a factor. This circumstance can essentially be attributed to the relatively high moisture content in the form of inert-crystalline water that the inorganic swelling additive has. A chemical in the interior that ensures expansion of the swelling additive under the effect of heat is also possible. In fact, the volume increase described comes about as the result of this effect of heat. This increase can be attributed, for the most part, to the sudden evaporation of the water previously bound in the structure, in each instance, or also of the chemical, which ensures the desired expansion. This effect is fundamentally known, and reference is made to DE 24 53 552 C3 in this regard.

The swelling indices given are generally determined in such a manner that the inorganic swelling additive in question is ground, if necessary, and then heated in a melting crucible. A conclusion concerning the swelling index can then be drawn from a comparison of the volume before and after heating. In most cases, the work is carried out with (swelling) temperatures of more than 300° C. at this point.

In this connection, of course, it must be ensured that the inorganic additive has not reached the aforementioned swelling temperatures of approximately 300° C. or even more before it is added to the mold sand, and, in particular, before the actual casting process. This requirement is needed because within the framework of the invention, the swelling additives, in each instance, advantageously arrange themselves in the region of binder bridges, which are established by the binder between the individual granular grains of the mold base material, in order to be able to present the casting mold in the desired shape.

The inorganic swelling additive that is present in the region of these binder bridges now ensures that at the casting temperatures that are reached, which generally lie above the indicated swelling temperatures of approximately 300° C. and more, the swelling additives in question expand. As a result, the binder bridges are broken up, so that the granular mineral mold material decomposes immediately after completion of the casting mold, because the binder no longer fulfills its original binding function for the production of the binder bridges. In other words, the bond between the individual grains of the mold base material or the mold sand is dissolved physically or mechanically, specifically via the inorganic swelling additive, which expands in precisely targeted manner and initiated by the casting process. In this connection, the aforementioned decomposition process can be controlled or regulated by way of the temperature and/or the selection or modification of the swelling additives, in each instance.

This control or regulation is possible because the various inorganic swelling agents demonstrate different temperature expansion behavior and consequently also different swelling temperatures at which the expansion process starts or reaches its maximum. Furthermore, it is possible to work with mixtures as the inorganic swelling additive, for example to mix vermiculite with perlite in a specific amount ratio. In this way, the swelling behavior of the inorganic swelling additive can be adjusted and controlled in precisely targeted manner, both with regard to the temperature behavior of expansion as such and also with regard to the expansions that are achieved.

In any case, according to the invention, organic additives are eliminated throughout, whether for presentation of the binder or as an additive or swelling additive. As a result, the emissions of carbon monoxide or even benzene, which are unavoidable in the state of the art, and the contaminations that result from them, are reliably prevented, already in terms of the approach. In addition, the expanding character of the swelling additive closes any pores remaining in the casting mold, specifically during the casting process, which reduces the casting surface and its roughness to a particular degree. Such reduction occurs because the liquid metal does not find any pores in the casting mold into which it can penetrate.

In addition, expanding graphite as an inorganic swelling additive, for example, has supplemental positive properties to the effect that possible parting oils, condensates, and also any benzene that might be formed are bound. This characteristic can be attributed to the high porosity of graphite and its non-polar character. In addition, graphite can be charged or combined with additional materials, which are embedded in the obligatory interstices. Sulfur can be advantageously used at this point. For example, so-called graphite bisulfate is known, which is produced via treating highly crystalline natural graphite with a mixture of sulfuric acid and with the addition of various oxidants.

In any case, it becomes clear that the inorganic swelling additive not only takes on or can take on the function of bursting the binder bridges between the individual grains of the granular mineral mold base material, but also is additionally able to bind individual, possibly harmful emissions, such as oil, benzene, or other condensation products, usually ones containing hydrocarbons. In addition, the inorganic swelling additive can be modified, in targeted manner, via additives or embedded materials such as sulfur, for example. In this connection, the embedded materials are automatically released during the swelling process that starts during the casting process, and can develop the desired effect.

Alternatively to the swelling additive described, it is also possible to have recourse to a conventional inorganic additive, particularly macro-crystalline graphite. For this additive, it holds true that the finished mixture of the mold base material, the additive, and the binder is advantageously compacted, specifically taking into consideration a density increase of at least 20 g/dm$^3$. With this density increase, the core sand and/or mold sand, i.e. the foundry sand or also foundry mold base material, can generally be strengthened in such a manner that casting defects are practically reduced to a minimum. Such reduction occurs because as a result of the increased mold compression, penetrations of the liquid casting material or metal into the casting mold can be reduced to a minimum. In this connection, of course, the swelling additive previously discussed can also be used as the additive. In any case, this additive is an inorganic additive, so that the harmful emissions previously observed in the state of the art no longer occur.

The macro-crystalline graphite as an additive is preferably a layer material that does not swell in water, having a marked planar splitability, which is preferably added in an amount of 0.1 wt.-% to 20 wt.-%, with reference to the inorganic binder used. This addition can take place, for example, during grinding of the bentonite that is advantageously used at this point. Preferably, 5 wt.-% to 20 wt.-% of the macro-crystalline graphite is added to the binder or to the bentonite, again with reference to the bentonite or binder used.

In this connection, bentonite, particularly bentonite activated via sodium ions, has proven to be advantageous as a binder. By working the macro-crystalline graphite into the binder, the binder is better and more rapidly absorbed in water, and develops its binding properties within a significantly shorter time than previously. Of course, the inorganic additive described can be combined with the inorganic swelling additive during production of the core sand and/or mold sand for foundry purposes.

In this connection, there are various possibilities, in detail, for further configuration. For example, the binder can be mixed with the inorganic additive or swelling additive before it is added to the granular mineral mold base material itself. Consequently, the inorganic binder and the inorganic swelling additive or additive form an inorganic pre-mixture, which can also be present as mixture particles or pre-mixture particles (pellets) itself.

Furthermore, it has proven to be advantageous if the binder and the swelling additive or additive are processed to form the mixture particles or also the pellets via common extrusion. Of course, other production methods are also possible for processing the binder and the swelling additive or additive to produce the aforementioned mixture particles or also pellets. A grain size of approximately 5 μm to 500 μm, particularly from 10 μm to 200 μm, is recommended as a grain size for the mixture particles or pre-mixture particles. The average grain size can lie at approximately 65 μm, whereby the mixture particles as a whole are subjected to a grinding process in order to adjust the indicated grain size spectrum.

This adjustment can be done, in detail, in such a manner that after extrusion, the grinding process described is carried out, and then, separation by grain sizes subsequently takes place, specifically by way of cyclones or other centrifugation devices, for example.

With regard to the inorganic swelling additive or additive, it is recommended to provide a separate screening procedure/grinding procedure at this point, and to work with a grain size in the range of 10 nm to 3000 nm. The average grain diameter should be approximately 1000 nm, i.e. 1 μm. In this manner, a particularly intimate connection between the binder and the inorganic swelling additive can be achieved because the binder is generally present in a grain size of originally approximately 10 μm to approximately 200 μm. The sheath or binding sheath that is responsible for the binding process between the individual grains of the mold base material when using bentonite, for example, has a layer thickness of approximately 3.5 μm. In this manner, the particles, i.e. grains of the swelling additive, which have a maximal size of 3 μm (3000 nm), can easily be introduced or embedded into the binding sheath in question (which has a greater layer thickness than the greatest grain diameter), of the bentonite or the binder. In this way, the swelling additive is disposed precisely in the region of the binding bridges previously discussed, and can develop its effect of breaking up the binding bridge, in each instance, in precisely targeted manner.

As a mold base material, a granular mineral sand is generally used. The granular mineral sand is generally present in an average grain size of less than 0.5 mm, whereby the grain size is usually in a range between 0.10 mm to 0.30 mm.

So that the inorganic additive is worked or can be worked directly into the sheath or binding sheath of the binder, it is recommended to process the two aforementioned components (binder and swelling additive) with one another. Such processing can be done via the extrusion process that has already been mentioned. This extrusion process directly ensures that the swelling additive penetrates into the binding sheath in question because the pressure prevailing in the required mold press for the extrusion process ensures this penetration. After the mixture particles have been formed from the binder and the swelling additive in this manner, the mixture particles or pellets in question are screened, as already mentioned, whereby subsequently, grain sizes preferably in the range from 10 μm to 200 μm, having an average grain diameter in the range of approximately 65 μm, are observed.

The aforementioned mixture particles or pre-mixture particles of the binder with embedded swelling additive and/or a looser pre-mixture of the binder and the swelling additive is subsequently mixed with the mold base material for the finished mixture. In this connection, the proportion of the mold base material is generally approximately 80 wt.-% or more in the finished mixture, while the remaining 20 wt.-%, as a maximum, are filled up by the binder, the inorganic additive or the swelling additive, and possibly one or more additional additives. These additives can be porous mineral materials or particles such as clinoptilolith, a catalyst such as manganese oxide, for example, zeolite (treated with silver), or the like, which splits up any harmful hydrocarbon emissions. Furthermore, it has proven itself if alternatively or additionally, an oxidant is added, in order to combust or split up any organic components that might have been absorbed.

The aforementioned oxidant can be added to the binder in a weight proportion of approximately 10 wt.-%, as an additive of calcium carbonate, for example. Furthermore, the oxidant can be implemented, according to the invention, so that the binder, i.e. the bentonite, is activated with sodium oxalate or comparable additives. Usually, a bentonite that contains at least 85 wt.-% montmorrilonite as the main component is used as the bentonite.

The finished mixture of the granular mineral mold material, the binder, and the swelling additive, as well as the additives, if applicable, is not compacted, in conclusion. Compacting can be done via a tamping device, which can be a mold press or also a ramming device having several rams. In most cases, however, compacting methods or corresponding devices are generally used nowadays, which ensure appropriate compacting via closing, via the production of air pulses, or via presses. As the result of this compacting process, a core sand and/or mold sand, i.e. a finished mixture is observed, whose density has a density increase in the range of more then 20 g/dm$^3$, particularly more than 30 g/dm$^3$.

By this increase in density, the mold sand can be processed with high compaction, and consequently, the casting mold produced from it is also present in the increased density. As a result of this high mold compaction, penetrations of the liquid casting material (metal) into the casting mold are reduced to a minimum. As a result, particularly smooth cast surfaces are observed. In addition, any harmful emissions during casting are bound or split up, because of the addition of the catalyst and/or of an oxidant. Bentonite with an additive of more than 9 wt.-% carbonate, with reference to the bentonite, i.e. the binder, can be used as an oxidant, for example.

In total, the addition of the inorganic additive or swelling additive having a swelling index of at least 9 and of the inorganic binder, according to the invention, i.e. their use for the production of a core sand and/or mold sand for foundry purposes, ensures that the flowability of the foundry mold sand is increased, and its decomposition after production of the cast work piece is accelerated, and, for the remainder, takes place almost free of residues. The additional introduction of additives, such as zeolite as a catalyst, for example, or of oxidants, optimizes the absorption of organic emissions that might be formed, after all, even though their production is reduced to a minimum in any case, per se, by means of doing without organic binders and organic additives, and also by means of the recourse to only inorganic additives. These features can be viewed as being significant advantages.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings.

DETAILED DESCRIPTION OF PREFERRED EMBODIMENTS

Exemplary Embodiment 1

Figure 1:
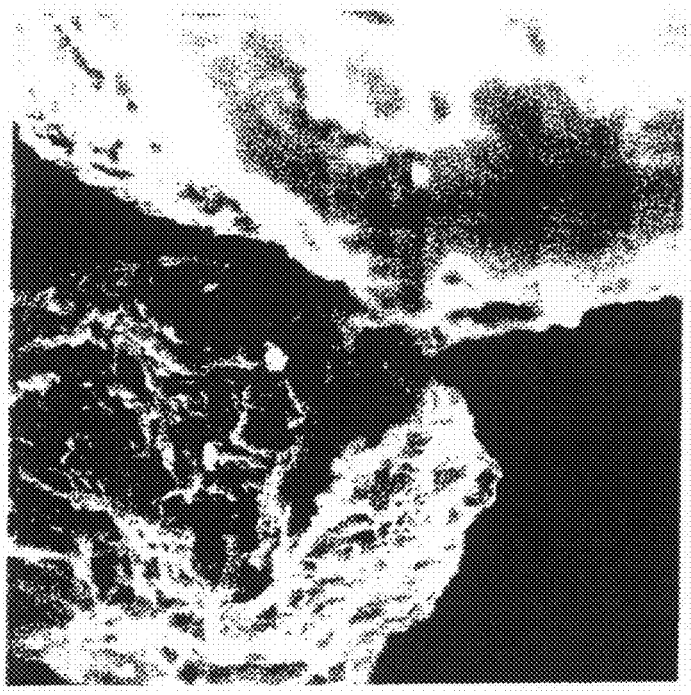
FIG. 1 is an electron microscope image of a foundry mold sand according to an embodiment of the invention in which the start of break up of the respective binding bridges can be seen.

Sodium-activated calcium bentonite as a binder is mixed with an inorganic swelling additive that is swelling graphite or vermiculite. The individual compositions are shown in the following table. In this connection, a differentiation is made, on the one hand, between a loose pre-mixture of the additive with the inorganic binder, and, on the other hand, between pellets that have been produced via prior combined extrusion of the additive with the swelling additive. The aforementioned pellets or the pre-mixture were dried and ground, so that on the output side, a water content of approximately 10 wt.-% is observed, and an average grain diameter of approximately 0.063 mm.

The pellets or pre-mixture particles were then screened and ground to an average grain size of approximately 65 μm. If a looser pre-mixture of the additive and the inorganic swelling additive was studied, an average grain size of approximately 65 μm was also adjusted. Subsequently, the foundry mold sand, i.e. the core sand and/or mold sand for foundry purposes, was produced in that the granular mineral mold base material, quartz sand in the exemplary embodiment, was filled into a pan grinder.

The quartz sand was mixed with 2.5 wt.-% (de-ionized) water for a period of one minute. Subsequently, the bentonite was added at approximately 7 wt.-% with reference to the mold base material, and the inorganic swelling additive was added at approximately 5 wt.-% with reference to the binder, i.e. the bentonite. Alternatively, the pellets of the binder, including embedded swelling additive, were filled into the pan grinder.

Subsequently, the finished mixtures were screened, specifically taking into consideration a 3 mm screen, so that on the output side, a foundry mold sand, i.e. a nodule-free finished mixture having the original grain distribution was available. Afterwards, the foundry mold sand in question was compacted, specifically, in the example, in a cylinder having a length of 100 mm and a diameter of 50 mm, at a pressure of 100 N/cm$^2$.

In this manner, it was possible to achieve compaction, i.e. a percentage volume decrease of the foundry mold sand in the cylinder by approximately 40%±2%. In fact, it was shown that compaction of at least 30%, i.e. a volume reduction by at least 30%, is required in order to present the desired properties, particularly with regard to the binding capacity of the surface of the foundry mold sand and consequently of the casting mold. In this connection, possible adjustments can be controlled by adding more or less water.

The following Table 1 shows a granular mold base material having an additive of only 7 wt.-% bentonite as a binder, with reference to the mold base material, in column 1. Column 2 shows the mold base material in question with an additive of 7 wt.-% bentonite as a binder and 2 wt.-% carbon as an organic additive, with reference to the mold base material, in each instance, corresponding to the state of the art.

Column 3 shows a granular mold base material with an additive of 7 wt.-% bentonite and 5 wt.-% swelling graphite. Column 4, just like column 3, shows the granular mold base material with 7 wt.-% bentonite as a binder and 5 wt.-% vermiculite as an inorganic swelling additive, added as loose mixture components, in each instance, and compacted in accordance with the example described.

Column 5 shows the mold base material plus 7 wt.-% bentonite and 5 wt.-% swelling graphite in accordance with the example in column 3, but in such a manner that the bentonite was extruded together with the swelling graphite to form the pellets or pre-mixture particles. Finally, column 6 shows the granular mold base material with an additive of 7 wt.-% bentonite and 5 wt.-% vermiculite as in the example of column 4, but again, in the form of mixture components or pellets that were produced via common extrusion. All of the finished mixtures were compacted as described.

TABLE 1

| | | 1 | 2 | 3 | 4 | 5 | 6 |
|---|---|---|---|---|---|---|---|
| Moisture content in wt.-% | % | 2.45 | 2.65 | 2.14 | 2.25 | 2.24 | 2.3 |
| Compaction, i.e. degree of compaction | % | 40.1 | 40.2 | 40.5 | 40.8 | 40.9 | 41.2 |
| "Green" pressure strength | N/cm$^2$ | 15.6 | 15.0 | 15.7 | 15.2 | 12.8 | 12.8 |
| Dry pressure strength at 150° C./3 h | N/cm$^2$ | 23.3 | 32 | 28.4 | 31.2 | 26.8 | 24.4 |
| Dry pressure strength at 350° C./1.5 h | N/cm$^2$ | 22.5 | 16.6 | 0 | 0 | 24.3 | 21.9 |
| Dry pressure strength at 550° C./45 min | N/cm$^2$ | 26.8 | 14.5 | 0 | 0 | 17.0 | 13.8 |
| Dry pressure strength at 750° C./30 min | N/cm$^2$ | 3.45 | 2.4 | 0 | 0 | 2.8 | 2.1 |
| Heat shear resistance at 15 sec | N/cm$^2$ | 2.46 | 2.27 | 2.38 | 2.32 | 2.0 | 2.4 |
| Heat shear resistance at 30 sec | N/cm$^2$ | 2.72 | 1.72 | 2.73 | 2.70 | 2.1 | 2.00 |

TABLE 1-continued

| | | 1 | 2 | 3 | 4 | 5 | 6 |
|---|---|---|---|---|---|---|---|
| Heat shear resistance at 60 sec | N/cm$^2$ | 4.7 | 5.2 | 1.28 | 3.60 | 3.4 | 3.4 |
| Heat shear resistance at 980° C./12 min | psi | 23.4 | 9.62 | 0 | 0 | 10.9 | 11.2 |

To measure the "green" pressure strength, three samples were produced according to the example, in each instance, and compacted to a diameter of 50 mm in the compaction device with the cylinder. The "green" pressure strength was then determined using a pressure strength meter. In order to determine the dry pressure strength, the individual samples were produced as for the determination of the "green" pressure strength. Before the samples were measured, however, they were brought to various temperatures for specific times, as indicated in the table.

In order to determine the heat shear resistance, a narrow region at the head of a sample body was heated very greatly, to temperatures of approximately 1000° C. After a certain time of 15, 30, or 60 sec, the binding strength of the foundry sand was measured. The heat pressure strength was measured using a Simpson & Gerosa high-temperature pressure strength tester. For this purpose, the sample was introduced into the tester and heated to temperatures up to 980° C. for a period of 12 min, and afterwards the maximal pressure strength was measured.

Exemplary Embodiment 2

In this case, a foundry mold sand was produced in that a mixture of bentonite, a macro-crystalline graphite, swelling graphite, and a porous additive component, i.e. a porous additive was added to the mold base material as a pre-mixture, as described in Example 1. The mixture components added to the mold base material contain approximately 85 wt.-% bentonite, 8.5 wt.-% of the macro-crystalline graphite, 3 wt.-% of the swelling graphite, and 3.5 wt.-% natural zeolite (clinoptilolith). These pre-mixture components as a whole are added to the mold base material at approximately 8 wt.-% with reference to the finished mixture, so that the mold base material assumes a proportion of approximately 92 wt.-% in the finished mixture.

This foundry mold sand mixture according to the invention is compared with a conventional mixture of a mold base material having 7 wt.-% bentonite and 2 wt.-% coal dust, which is characterized as "state of the art" in the following Table 2.

TABLE 2

| | | State of the art | Invention |
|---|---|---|---|
| Compression, i.e. degree of compression | % | 40 | 40 |
| Density | g/dm$^3$ | 1505 | 1545 |
| Dry pressure resistance at 150° C./3 h | N/cm2 | 27 | 35 |
| Dry pressure resistance at 350° C./1.5 h | N/cm2 | 19 | 0 |
| Dry pressure resistance at 550° C./45 min | N/cm2 | 16 | 0 |

On the basis of Tables 1 and 2 it becomes clear that for the foundry mold sand according to the invention, (dry) pressure strength values of 0 N/cm$^2$ are often observed, already at a treatment at 300° C. and a duration of 1.5 hours. These values mean that the foundry mold sand according to the invention that is in question has decomposed, for the most part, during the treatment. In the range below 350° C., comparable pressure strength values as in the case of conventional foundry mold sands are observed, so that casting molds having conventional properties can be produced.

The binding effect has also decreased drastically, which supports the interpretation already given before, that the foundry mold sand according to the invention reliably decomposes immediately after production of the casting material. In this connection, the mold base material as a whole is not destroyed and can easily be processed again, whereby recycling rates, i.e. regeneration rates for the mold base material of up to 98% were observed. This means that during a casting procedure, maximally only 2 wt.-% of mold base material are lost, as a rule.

A comparison of the two columns according to Table 2 shows that according to the invention, the density has been increased by approximately 40 g/dm$^3$, in other words corresponds to a corresponding density increase. In fact, a density increase of approximately 35 g/dm$^3$ was already achieved in a single compaction process. Despite this density increase and the overall high density of the foundry mold sand according to the invention, excellent decomposition is observed, specifically already at 350° C., as the dry pressure strength of 0 N/cm$^2$ makes clear.

Figure 2:
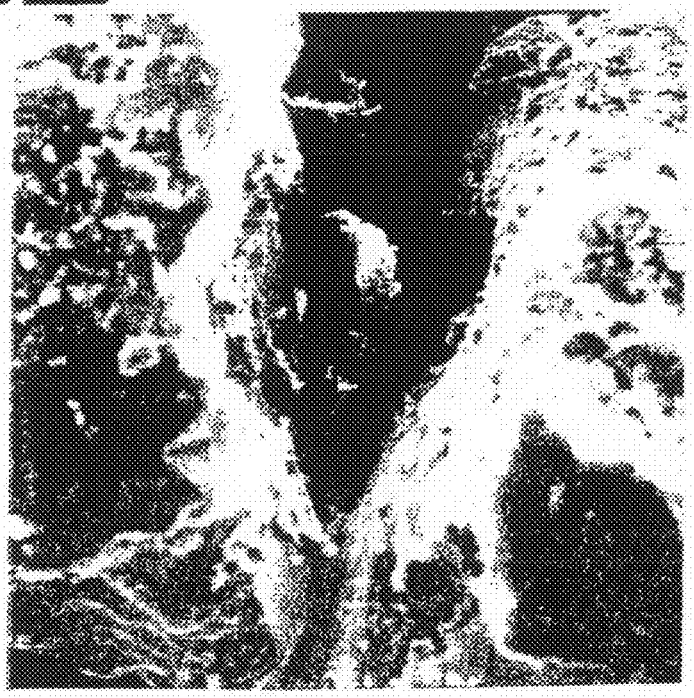
FIG. 2 is an electron microscope image of the embodiment of FIG. 1 in which the binding bridge is broken up.

The following two electron microscope images support this assessment. FIG. 1 shows a foundry mold sand according to Exemplary Embodiment 2. In FIG. 1, the start of breakup of the binding bridge, in each instance, can be seen, while FIG. 2 shows the binding bridge broken up.

In this connection, it becomes clear that the binding bridge between the individual grains of the mold base material that are shown is broken up. In fact, fireclay-type bridges of the binder are broken up and off using the inorganic swelling additive. In this way, the thickness of any fireclay sheath that might surround the individual grain of sand is reduced. This reduction facilitates cleaning during re-use and supports the desired decomposition process, so that after cooling of the foundry mold sand, good separation of cast part and mold material, i.e. casting mold via screening becomes possible. This separation can take place immediately after production of the cast work piece. Of course, the method described can also be combined with other additives, for example with conventional coal.

Although only a few embodiments of the present invention has been shown and described, it is to be understood that many changes and modifications may be made thereunto without departing from the spirit and scope of the invention as defined in the appended claims.

What is claimed is:

1. A method for the production of a core sand and/or a mold sand for foundry purposes, comprising the steps of:

providing a separate screening/grinding process to produce said inorganic binder having a swelling index of at least 20 with a grain size of approximately 10 μm to approximately 200 μm, and to produce said inorganic swelling additive with an average grain diameter of approximately 1 μm; and mixing a granular mineral mold base material with the inorganic swelling additive, and with the inorganic binder to form a finished mixture;

compacting the finished mixture composed of said mold base material, said inorganic swelling additive, and said inorganic binder to form a compacted mixture having an increased density of at least 20 g/dm$^3$ over the finished mixture.

2. The method according to claim 1, wherein the inorganic swelling additive comprises macro-crystalline graphite; and said inorganic swelling additive is added in an amount of approximately 0.1 wt.-% to 20 wt.-% with reference to said binder.

3. The method according to claim 2, wherein the finished mixture is compacted by closing, air pulse, or pressing.

4. The method according to claim 1, wherein said inorganic swelling additive is added in an amount of 5 wt.-% to 30 wt.-% with reference to said binder.

5. The method according to claim 1, wherein the binder is first mixed with the inorganic swelling additive to form a first mold mixture and then the first mold mixture is added to the mold base material.

6. The method according to claim 5, wherein the first mold mixture is dried to a water content of less than 20 wt.-%.

7. The method according to claim 6, wherein the first mold mixture is dried to a water content of less than 10 wt.-%.

8. The method according to claim 5, wherein the first mold mixture contains approximately 80 wt.-% or more binder and approximately 20 wt.-% or less inorganic swelling additive.

9. The method according to claim 8, wherein at least one of a catalyst and an oxidant is added to the inorganic swelling additive and to the binder as additional additives.

10. The method according to claim 9, wherein the additional additives comprise bentonite having more than 10 wt.-% carbonate.

11. The method according to claim 1, wherein the binder and the inorganic swelling additive are prepared to form mixture particles or pellets for addition to the mold base material via common extrusion.

12. The method according to claim 11, wherein the mixture particles or pellets are screened up to a grain size of 5 μm to 500 μm.

13. The method according to claim 12, wherein the mixture particles or pellets are screened up to a grain size from 10 μm to 200 μm.

14. The method according to claim 1, wherein the inorganic swelling additive is used in a grain size in the range of 10 nm to 3000 nm.

* * * * *